US008281635B2

(12) United States Patent
Beppu

(10) Patent No.: US 8,281,635 B2
(45) Date of Patent: Oct. 9, 2012

(54) PRODUCTION METHOD OF INTERNALLY RIBBED STEEL TUBE AND DRAWING PLUG FOR USE THEREIN

(75) Inventor: Kenichi Beppu, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 155 days.

(21) Appl. No.: 12/823,462

(22) Filed: Jun. 25, 2010

(65) Prior Publication Data

US 2010/0319425 A1 Dec. 23, 2010

Related U.S. Application Data

(63) Continuation of application No. PCT/JP2008/069545, filed on Oct. 28, 2008.

(30) Foreign Application Priority Data

Dec. 26, 2007 (JP) ..... 2007-334087

(51) Int. Cl.
*B21C 1/24* (2006.01)

(52) U.S. Cl. ..... 72/283; 729/209; 729/370.17

(58) Field of Classification Search ..... 72/41, 42, 72/208, 209, 283, 367.1, 368, 370.01, 370.16, 72/370.17, 370.21, 95
See application file for complete search history.

(56) References Cited

U.S. PATENT DOCUMENTS 3,036,696 A * 5/1962 Zimpel ..... 72/348
3,293,894 A * 12/1966 Edgecombe et al. ..... 72/42
4,745,787 A * 5/1988 Sansome et al. ..... 72/41
5,881,592 A * 3/1999 Blackwell et al. ..... 72/283
6,913,074 B2 * 7/2005 Yamamoto et al. ..... 165/184
7,021,106 B2 * 4/2006 Jesson et al. ..... 72/283

FOREIGN PATENT DOCUMENTS

| | | |
|---|---|---|
| EP | 1 270 708 | 1/2003 |
| JP | 54-120446 | * 9/1979 |
| JP | 63-260621 | 10/1988 |
| JP | 2-31205 | 8/1990 |
| JP | 2001-179327 | 7/2001 |
| JP | 2002-361319 | 12/2002 |
| JP | 2003-80337 | 3/2003 |
| JP | 2006-272392 | 10/2006 |

* cited by examiner

*Primary Examiner* — Edward Tolan
(74) *Attorney, Agent, or Firm* — Clark & Brody

(57) ABSTRACT

There is provided a production method capable of forming spiral ribs stably by reducing troubles at the time of cold drawing for forming the spiral ribs on an internally ribbed steel tube. When the internally ribbed steel tube on which a plurality of stripes of spiral ribs are formed in the tube axis direction is manufactured by inserting a plug on which a plurality of stripes of spiral grooves are formed on the outer peripheral surface thereof into the tube to be worked subjected to chemical treatment and then performing cold drawing, drawing is performed with the plug preheated to 50 to 200° C., thus forming the spiral ribs on the internal surface of a blank tube. The chemical treatment preferably includes a pickling step of removing oxided scale and rust on the tube surface, a step of forming a zinc phosphate coat on the neutralized tube surface, and a step of forming a lubricating layer on the zinc phosphate coat. The internally ribbed steel tube thus obtained is well applicable to increased capacity and higher temperature/higher pressure of a boiler because the steel tube is provided with formability and quality excellent as a boiler steel tube.

2 Claims, 2 Drawing Sheets

PRODUCTION METHOD OF INTERNALLY RIBBED STEEL TUBE AND DRAWING PLUG FOR USE THEREIN

"This application is a continuation of International Patent Application No. PCT/JP2008/069545, filed Oct. 28, 2008. This PCT application was not in English as published under PCT Article 21(2)."

TECHNICAL FIELD

The present invention relates to a production method of an internally ribbed steel tube, forming spiral ribs (protrusions) on the internal surface of a steel tube by cold drawing, and a drawing plug therefor. More particularly, the invention relates to a production method of an internally ribbed steel tube, capable of forming spiral ribs stably, and a drawing plug for use in the production method.

BACKGROUND ART

Usually, for a high temperature heat resistant part of a boiler, a heat exchanger, or the like, an internally ribbed steel tube (rifled tube) with spiral ribs (protrusions) formed on the internal surface of the steel tube is used to improve a power generation efficiency. Since the internal surface of the internally ribbed steel tube has a larger surface area by the ribs formed on the internal surface, a contact area between water vapor passing through the inside of heated tube and the internal surface of the tube increases, while allowing turbulence to occur in a fluid containing water vapor, thereby enabling a heat exchange efficiency to be enhanced. With a recent tendency of increased capacity and higher temperature/higher pressure service for the boiler, the demand for the internally ribbed steel tube has increased rapidly.

To produce the internally ribbed steel tube, a seamless steel tube or an electric resistance welded steel tube is used as a blank tube, the blank tube is sufficiently softened as necessary, and then in a cold working process a drawing die and a plug, which has spiral grooves on its outer peripheral surface for forming ribs for the tube, are used to draw the tube.

FIG. 1 is an explanatory view for schematically illustrating a method for producing an internally ribbed steel tube by cold drawing. When a blank tube 3 is cold drawn, a plug 1 is inserted into the blank tube 3 in a concentric manner relative to a die 2 and the blank tube 3 while one end of the plug 1 is held by a mandrel 4, and the blank tube 3 is drawn in the direction indicated by a hollow arrow while allowing the plug 1 to be rotated.

At this time, the external surface of the blank tube 3 is reduced by the die 2. Meanwhile, the internal surface of the blank tube 3 is pressed and processed along spiral grooves 1*a* provided on the outer peripheral surface of the plug 1 so that spiral ribs 3*a* are formed on the inner peripheral surface of the drawn blank tube 3.

The plug 1 has a structure such that one end thereof is held by the mandrel 4, and the plug 1 can be rotated freely. The plug shape greatly affects the dimensional accuracy such as rib height and rib shape (especially, rib corner part and lead angle) of the internally ribbed steel tube, and the seizure occurs between the blank tube and the plug depending on the drawing conditions. Therefore, for the production of internally ribbed steel tube, a drawing plug which has spiral grooves of a predetermined shape on its outer surface has conventionally been used.

FIG. 2 is schematic views showing cross-sectional shapes of a spiral groove formed in the drawing plug to be used for the production of an internally ribbed steel tube. The schematic views show, in stages, cross-sectional shapes perpendicular to the plug axis line for a representative spiral groove among those shown in FIG. 1. FIG. 2(*a*) is a sectional view from A-A of FIG. 1, FIG. 2(*b*) is a sectional view from B-B of FIG. 1, and FIG. 2(*c*) is a sectional view from C-C of FIG. 1.

Usually, the drawing plug for the internally ribbed steel tube is configured so that as side walls 1*aa* as being opposed to each other and a bottom surface 1*ab* constitutes each spiral groove to provide a plurality of stripes of spiral grooves 1*a* in the outer peripheral surface of the drawing plug, the radius of curvature r of a corner portion, where each of the side walls 1*aa* meets a bottom surface 1*ab*, be sufficiently large on the plug front end part of plug shown in FIG. 2(*c*), and it become gradually smaller toward the plug rear end part as shown in FIGS. 2(*c*) and 2(*b*). With the drawing plug being configured in this manner, each rib is formed in a staged manner on the internal surface of the blank tube, so that the seizure is unlikely to occur.

FIG. 3 is another embodiment, schematic views showing the cross-sectional shapes of the spiral groove formed in the drawing plug used for the production of an internally ribbed steel tube. Similarly to FIG. 2, FIG. 3 shows, in stages, cross-sectional shapes perpendicular to the plug axis line for a spiral groove. FIG. 3(*a*) is a sectional view from A-A of FIG. 1, FIG. 3(*b*) is a sectional view from B-B of FIG. 1, and FIG. 3(*c*) is a sectional view from C-C of FIG. 1.

The drawing plug shown in FIG. 3 is configured so that as side walls 1*aa* as opposed to each other and a bottom surface 1*ab* constitutes each spiral groove to provide a plurality of stripes of spiral grooves 1*a* in the outer peripheral surface of the drawing plug, the radius of curvature r of a corner portion, where each of the side walls 1*aa* meets the bottom surface 1*ab*, is kept constant all the way from the front end part of plug to the rear end part thereof, while the plug decreases in diameter, for example, at a gradient of 3 degrees from the plug front end part toward the plug rear end part. This also allows ribs to be formed on the internal surface of blank tube in a staged manner at a constant deformation reduction rate, so that the seizure is less likely to occur (refer to Japanese Patent Application Publication No. 2001-179327).

Further, although the cross-sectional shape of drawing plug is not shown, it sometime happens to use a drawing plug in which, in addition to the gradual change in the cross-sectional shape of the spiral groove formed in the drawing plug as shown in FIGS. 2 and 3, both edges of a spiral groove ridge is rounded or chamfered linearly to reduce the area of contact between the top surface of groove ridge and the internal surface of blank tube at the time of cold drawing, thereby reducing frictional resistance occurring between the groove ridge top surface and the blank tube (refer to Japanese Patent Application Publication No. 2006-272392).

DISCLOSURE OF THE INVENTION

Usually, since Standards to be applied to the internally ribbed steel tube are JIS G3461 (STB) and JIS G3462 (STBA), carbon steel or Cr-based low-alloy steel is used as the steel type for the starting material. In the case where such a steel type is used for the blank tube, sulfuric acid pickling is performed for descaling, and chemical treatment by phosphate treatment (zinc phosphate etc.) is performed for lubricating treatment. The specific procedure for pickling/lubricating treatment is as follows: after descaling, the internal and external surfaces of blank tube are rinsed by water, neutralized, and water-rinsed by mere dipping, and the blank tube is immersed in a phosphate treatment bath to form a phosphate substrate on the internal and external surfaces. Next, the surfaces of blank tube are rinsed by hot water and are subjected to soap treatment using sodium stearate as the principal component, and thereafter are dried using hot air.

In producing the internally ribbed steel tube, however, even if optimal chemical treatment is performed on the surfaces of blank tube under proper conditions as described later, before the cold drawing for forming the spiral ribs, drawing troubles occur frequently depending on the treatment conditions of a drawing plug, and the formability and production yield of the internally ribbed steel tube may be deteriorated remarkably.

The present invention has been made to solve the above-described problems with cold drawing of internally ribbed steel tube, and accordingly an object thereof is to provide a production method of an internally ribbed steel tube, in which a drawing plug is preheated before cold drawing for forming spiral ribs, and the heating temperature therefor is controlled, whereby troubles at the time of cold drawing for forming the spiral ribs are reduced, and the spiral ribs can be formed stably.

The cold drawing of internally ribbed steel tube is performed by using a plug on which spiral grooves each having a cross-sectional shape as shown in FIG. 2 or FIG. 3 are formed on the outer peripheral surface thereof and by inserting this plug into a blank tube subjected to chemical treatment. At this time, as the diameter of the external surface of blank tube is reduced, ribs are formed at a constant cold work rate on the internal surface of blank tube. Therefore, due to heat generated by plastic deformation, the cold drawing for forming the spiral ribs locally generates an elevated-temperature spot.

In the cold drawing of internally ribbed steel tube, as shown in FIG. 1, the top surface of the spiral groove ridge provided on the drawing plug is always in contact with the blank tube surface all the way from the initial stage of the contact to the final stage of rib formation at which the blank tube is processed to a product size. Therefore, the length of contact of the plug with the blank tube is inevitably long.

For example, it is generally recognized that the length of contact of the plug with the blank tube in the cold drawing of an ordinary boiler steel tube and heat exchanger steel tube is about 3 mm at best, although depending on a dimensional arrangement in cold drawing. However, when the internally ribbed steel tube having a product size of 28 to 70 mm in outside diameter is produced, the length of contact of the plug with the blank tube comes up to 10 to 15 mm. With the increase in the length of contact of the plug with the blank tube as described above, the seizure is likely to occur on the internally ribbed steel tube, which makes the cold drawing of the internally ribbed steel tube to a hostile plastic deformation.

To stably perform the cold drawing for forming the spiral ribs regardless of the length of contact of the plug with the blank tube, it is necessary to maintain a film-interposed contact between the spiral grooves provided in the drawing plug and the internal surface of blank tube, wherein a chemical treatment film is interposed therebetween, during the time from the initial stage of deformation to the final stage thereof at which the blank tube is processed to a product size.

The present inventor paid attention to the above-described technical aspects concerning the cold drawing of internally ribbed steel tube, and conducted various studies. As a result, the present inventor obtained a finding that before the cold drawing for forming the spiral ribs, the drawing plug be preheated, and the heating temperature therefor be controlled so as to be in the temperature range suitable for cold drawing locally generating an elevated-temperature zone, whereby troubles at the time of cold drawing for forming the spiral ribs can be reduced.

The present invention was completed based on the above-described finding, and the gists thereof are the production methods of an internally ribbed steel tube as described in the following items (1) and (2) and the drawing plug for drawing the internally ribbed steel tube as described in the item (3).

(1) A production method of an internally ribbed steel tube, in which a plug having a plurality of stripes of spiral grooves formed on the outer peripheral surface thereof is inserted into a chemically treated tube to be worked, and cold drawing is performed to form a plurality of stripes of spiral ribs along a tube axis direction, the method including drawing the tube with the plug preheated in a temperature range of 50 to 200° C., whereby the spiral ribs are formed on the internal surface of the tube to be worked.

(2) In the production method of an internally ribbed steel tube described in the above item (1), a chemical treatment is preferably performed, the treatment comprising the steps of: pickling for removing oxide scale and rust on the tube surface; forming a zinc phosphate coat on the tube surface that is treated by neutralization; and forming a lubricant layer on the zinc phosphate coat.

(3) A drawing plug used for producing an internally ribbed steel tube, which is held by a mandrel at its rear end and is used in the production method of an internally ribbed steel tube described in the above item (1) or (2), wherein a plurality of stripes of spiral grooves are formed on the drawing plug for use in forming the ribs in the outer peripheral surface thereof, and the radius of curvature of a corner portion in which each of spiral groove side walls as being opposed to each other meets a groove bottom surface is decreased gradually all the way from the plug front end part to the plug rear end part.

Further, it is preferable that the radius of curvature of an edge portion in which each of spiral groove side walls meets a groove ridge top surface be also decreased gradually all the way from the plug front end part to the plug rear end part.

According to the production method of an internally ribbed steel tube in accordance with the present invention, the drawing plug is preheated before cold drawing for forming spiral ribs, and the heating temperature therefor is properly controlled, whereby troubles at the time of cold drawing for forming the spiral ribs are suppressed, and the spiral ribs can be formed stably. The internally ribbed steel tube thus obtained is excellent in formidability and quality.

BEST MODE FOR CARRYING OUT THE INVENTION

The steel types to be used for the internally ribbed steel tube in accordance with the present invention are carbon steel (for example, JIS G3461, STB340 to 510) and Cr-based low-alloy steel (for example, JIS G3462, STBA12 to 24), and a seamless steel tube or an electric resistance welded steel tube can be used as a blank tube.

Usually, the seamless steel tube is produced by hot rolling using a mandrel mill tube-making method for its high production efficiency. The electric resistance welded steel tube is produced by the electric resistance welding process incorporating technologies of an inert-gas shielded arc welding process and automatically controlling the welding heat input so as to prevent the oxidation of weld zone and to stabilize the weld bead.

At the stage of producing a blank tube, it is decided according to the steel type and production conditions whether blank tube softening treatment is required. Next, immediately after being softened or even in case without the softening treatment, the blank tube on the internal surface of which ribs are to be formed is subjected to a chemical treatment before rib-forming cold drawing to provide a lubricant film on the internal and external surfaces of the blank tube.

Figure 4:
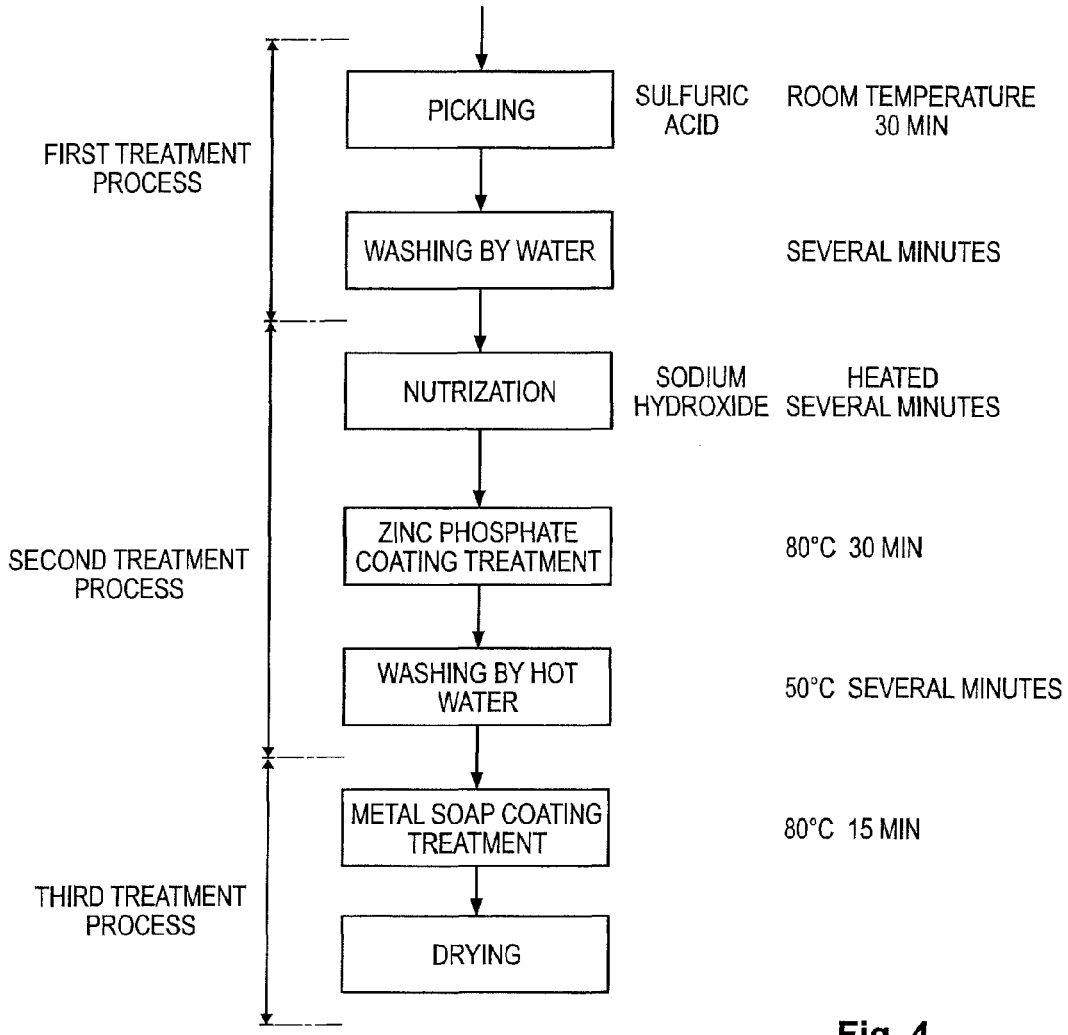
FIG. 4 is a block diagram showing a process example of a chemical treatment applicable to a production method of an internally ribbed steel tube in accordance with the present invention.

FIG. 4 is a block diagram showing a process example of the chemical treatment applicable to the production method of an internally ribbed steel tube in accordance with the present invention. First, pickling is performed as a first treatment step to remove oxide scale and rust adhering to the surfaces. Usually, as the acid to be used, sulfuric acid (10 to 13%) is used, and an extent of free acid and iron concentration are used as control factors. As a rough guide for pickling conditions, an immersion time of 30 minutes under room temperature as the treatment temperature is adopted. After the pickling, cleaning by water (for example, about several minutes) is performed to wash away the acid remaining on the surface.

Following the above-described pickling step, the blank tube is immersed in sodium hydroxide solution to perform neutralization. By this neutralization, the blank tube surface can be stabilized. Thereafter, as a second treatment process, zinc phosphate coating treatment is performed to form a substrate of phosphate coating on the blank tube surface. As a rough guide of conditions for zinc phosphate coating treatment, the treatment temperature is set to about 80° C. and immersed in the bath for 30 minutes. After this zinc phosphate coating treatment, the blank tube is rinsed by hot water (for example, at a treatment temperature of 50° C. for about several minutes).

Subsequently, as a third treatment process, the formed zinc phosphate coat is allowed to react with soap-based lubricant to form a lubricating layer on the surface. As the treatment for forming the lubricating layer, a metal soap layer is generally formed by allowing sodium stearate to react with the zinc phosphate coat. In the production method in accordance with the present invention, the treatment method for forming the lubricating layer is not limited to the above-described method.

As a rough guide of treatment conditions for forming the lubricating layer, the treatment temperature is set to about 80° C. and immersion time is set to 15 minutes. The blank tube subjected to the chemical treatment by the above-described first to third treatment processes is allowed to dry. To dry the blank tube surface sufficiently, it is possible to use a method in which the blank tube is charged into a continuous drying furnace to be dried in a high-temperature atmosphere.

In the production method in accordance with the present invention, when the cold drawing is performed to form the spiral ribs, in order to maintain stable contact between the spiral grooves of the drawing plug and the internal surface of blank tube via the chemical treatment film during the time from the initial stage of cold drawing to the final stage at which the blank tube is processed into a product size, it is necessary to preheat the drawing plug and to control the heating temperature therefor to 50 to 200° C.

In the case where the preheating of the drawing plug is not performed before the cold drawing for forming the spiral ribs, or in the case where even if the preheating is performed, the heating temperature of drawing plug does not reach 50° C., the seizure is likely to occur in the rib forming part on the internal surface of blank tube when cold drawing is started. If the seizure occurs when cold drawing is started, it would be difficult to continue the cold drawing, and troubles such as the tearing off of the blank tube and/or the tearing apart and damaging the drawing plug may occur.

On the other hand, in the case where the heating temperature exceeds 200° C. due to the preheating of drawing plug, the chemical treatment film is destroyed, and during the time from the initial stage of cold drawing to the final stage at which the blank tube is processed into the product size, a sufficient chemical treatment film cannot be interposed between the spiral groove of the drawing plug and the internal surface of blank tube. Therefore, the seizure is likely to occur on the internally ribbed steel tube.

In the production method in accordance with the present invention, therefore, the cold drawing is performed with the drawing plug to be inserted into the blank tube preheated to a temperature of 50 to 200° C., whereby troubles at the time of cold drawing for forming the spiral ribs are reduced. Therefore, an internally ribbed steel tube excellent in dimensional accuracy and production yield can be produced.

The specific preheating procedure is as follows: a heating zone comprised by a heating coil is configured to have a ring shape, and the drawing plug is inserted into the ring-shaped heating zone and is heated to the predetermined temperature range. The heating timing may be either before the drawing plug is set to be held by the mandrel, or before the cold drawing for forming the spiral ribs in case the drawing plug is already held by the mandrel.

Figure 1:
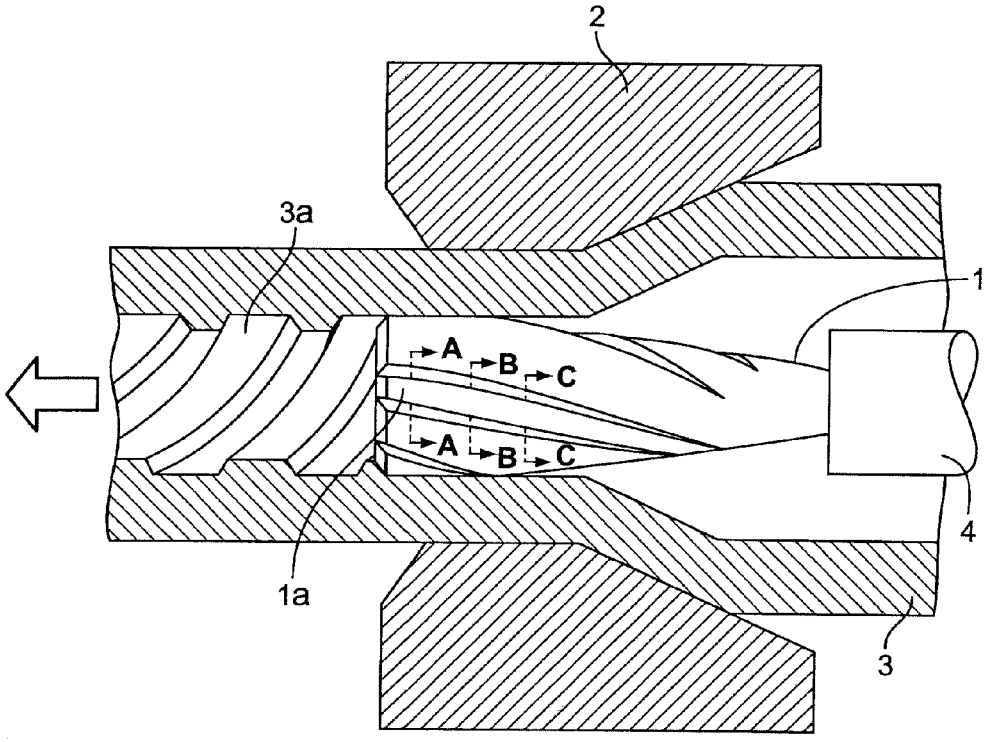
FIG. 1 is an explanatory view for schematically illustrating a method for producing an internally ribbed steel tube by cold drawing.
Figure 2:
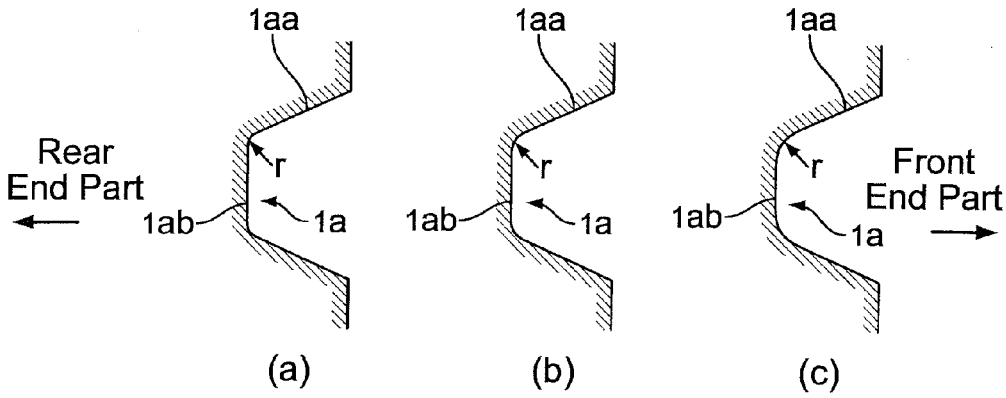
FIG. 2 is schematic views showing the cross-sectional shapes of a spiral groove provided on a drawing plug to be used for the production of an internally ribbed steel tube.

The drawing plug in accordance with the present invention may have an outer peripheral surface configuration that allows the ribs to be in a staged manner formed on the internal surface of blank tube. For example, as shown in FIG. 2, the plug may have a configuration in which as side walls as being opposed to each other and a bottom surface constitutes each spiral groove to provide a plurality of stripes of spiral grooves 1*a* on the outer peripheral surface for use in forming the ribs, the radius of curvature r of a corner portion in which each of the side walls 1*aa* meets a bottom surface 1*ab* decreases gradually all the way from a plug front end part to a plug rear end part thereof, the plug being held by the mandrel.

Although not shown, the drawing plug in accordance with the present invention can be configured so that as the plurality of stripes of spiral grooves are provided in the outer peripheral surface thereof, the radius of curvature r of the edge portion in which each of side walls meets the top surface of groove ridge decreases gradually all the way from the plug front end part to the plug rear end part, the plug being held by the mandrel.

Figure 3:
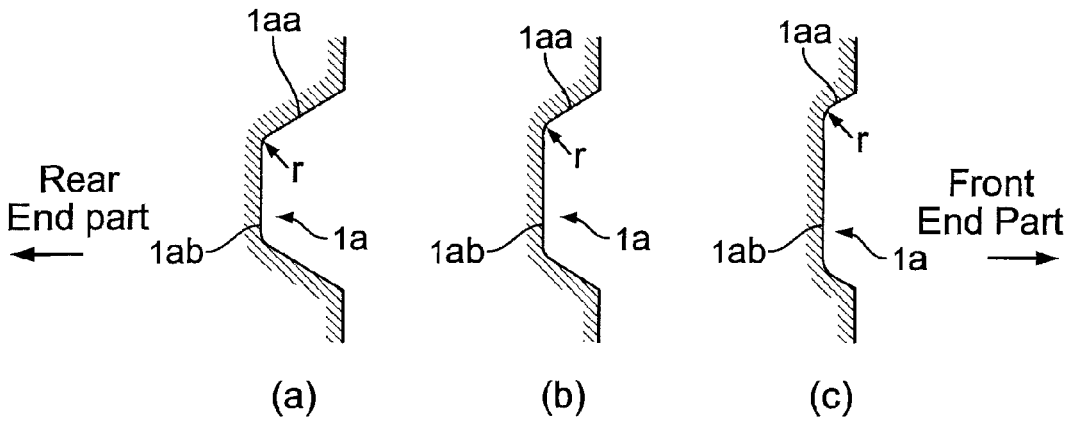
FIG. 3 is another embodiment and schematic views showing the cross-sectional shapes of a spiral groove provided on the drawing plug to be used for the production of an internally ribbed steel tube.

For the same reason, as shown in FIG. 3 as another embodiment, the drawing plug in accordance with the present invention can be configured so that as the plurality of stripes of spiral grooves 1*a* are provided on the outer peripheral surface for use in forming the ribs, the radius of curvature r of the corner portion in which each of the side walls 1*aa* forming the spiral groove meets the bottom surface 1*ab* is kept constant all the way from the plug front end part to the plug rear end part side, the plug being held by the mandrel, and the diameter of the plug decreases at a fixed gradient from the plug front end part toward the plug rear end part.

The internally ribbed steel tube provided by the present invention is produced by using the drawing plug of the present invention in the above-described production method, and is well applicable to increased capacity and higher temperature/higher pressure service condition for a boiler because said steel tubes exhibit excellent formability and dimensional accuracy as a boiler steel tube. Hereunder, the effects achieved by the production method in accordance with the present invention are described based on specific Examples.

EXAMPLES

Example 1

In Example 1, internally ribbed steel tubes having four stripes of spiral ribs were produced by cold drawing using a seamless steel tube blank whose steel type was JIS STBA22 (1Cr-1/2Mo steel) after subjecting the blank tube to a series of steps: blank tube softening—pickling/lubricating treatment—intermediate cold drawing (circle finish drawing)—softening.

The drawing schedule in this Example was such that the blank tube size was comprised by 38.0 mm in outside diameter and 8.2 mm in wall thickness, dimensions after the intermediate cold drawing were 32.0 mm in outside diameter and 7.2 mm in wall thickness, and the final product dimensions after cold drawing were 28.6 mm in outside diameter, 6.0 mm in wall thickness, and 0.8 mm in rib depth.

As the chemical treatment before cold drawing for finally forming the spiral ribs, pickling was performed using sulfuric acid (10 to 13%) at room temperature for 30 minutes, and after rinsing by water and neutralization, zinc phosphate coating treatment was performed at 75 to 85° C. for 30 minutes. Then, a metal soap layer was formed by allowing sodium stearate to react with zinc phosphate coat at 75 to 85° C. for 15 minutes.

The drawing plug used was the one on which a plurality of stripes of spiral grooves having the cross-sectional shape shown in FIG. 2 are provided on the outer peripheral surface thereof. The drawing plug was inserted into a ring-shaped heating zone comprised by a heating coil and was preheated. After the drawing plug was heated to the predetermined temperature range, cold drawing for forming spiral ribs was performed.

The preheating temperature for the drawing plug and the operation state of the cold drawing in this Example are given in Table 1. In the column of cold drawing operation state in Table 1, ○ indicates no occurrence of seizure, Δ indicates occurrence of benign seizure, and x indicates occurrence of notable seizure defective.

TABLE 1

| Test No. | Classification | Drawing plug used | Preheating temperature (° C.) | Cold drawing operation state: observation result |
|---|---|---|---|---|
| 1 | Comparative Example 1 | Plug having spiral grooves of cross-sectional shape shown in FIG. 2 | *Room temperature | x |
| 2 | Inventive Example 1 | | 50 | ○ |
| 3 | Inventive Example 2 | | 120 | ○ |
| 4 | Inventive Example 3 | | 200 | ○ |
| 5 | Comparative Example 2 | | *220 | Δ |

Note)
*mark in the table indicates deviation from specified range of the present invention.

As shown in Table 1, in Inventive Examples 1 to 3 in which the preheating temperature was in the range specified in the present invention, the seizure defects were not discernible on the internally ribbed steel tube finished by final cold drawing.

In Comparative Example 1 in which the preheating was not performed, seizure defects are generated at the beginning of cold drawing, and a trouble of tearing apart a blank tube occurred. Also, in Comparative Example 2 in which the preheating temperature is out of the range specified in the present invention, although the seizure defects were not generated on the internally ribbed steel tube finished by cold drawing, benign seizure occurred in a part of formed ribs on the internal surface of blank tube.

Example 2

In Example 2, internally ribbed steel tubes having four stripes of spiral ribs were produced by cold drawing using a seamless steel tube blank whose steel type was JIS STBA24 (2Cr-1Mo steel) after subjecting the blank tube to a series of steps: blank tube softening—pickling/lubricating treatment—intermediate cold drawing (circle finish drawing)—softening.

The drawing schedule in this Example was such that the blank tube size was comprised by 87.0 mm in outside diameter and 10.2 mm in wall thickness, dimensions after the intermediate cold drawing were 80.0 mm in outside diameter and 9.2 mm in wall thickness, and the final product dimensions after cold drawing were 70.0 mm in outside diameter, 8.0 mm in wall thickness, and 1.1 mm in rib depth.

The conditions for chemical treatment before final cold drawing for forming the spiral ribs were the same as those in Example 1. Also, the shape of the drawing plug used and the preheating of the drawing plug were the same as those in Example 1. After the drawing plug was heated to the predetermined temperature range, cold drawing for forming spiral ribs was performed.

The preheating temperature of drawing plug and the cold drawing operation state in this Example are given in Table 2. The evaluation procedure based on the observation result of cold drawing operation state is the same as that in Example 1.

TABLE 2

| Test No. | Classification | Drawing plug used | Preheating temperature (° C.) | Cold drawing Operation state observation result |
|---|---|---|---|---|
| 6 | Comparative Example 3 | Plug having spiral grooves of cross-sectional shape shown in FIG. 2 | *40 | x |
| 7 | Inventive Example 4 | | 60 | ○ |
| 8 | Inventive Example 5 | | 130 | ○ |
| 9 | Inventive Example 6 | | 190 | ○ |
| 10 | Comparative Example 4 | | *250 | x |

Note)
*mark in the table indicates deviation from specified range of the present invention.

As in Example 1, in Inventive Examples 4 to 6 in which the preheating temperature was in the range specified in the present invention, seizure defects were not discernible on the internally ribbed steel tube finished by final cold drawing.

In Comparative Example 3 in which the preheating temperature did not reach the preheating temperature specified in the present invention, notable seizure occurred in the rib forming part on the internal surface of blank tube at the beginning of cold drawing. Also, in comparative example 4 in which the preheating temperature exceeded the preheating temperature specified in the present invention, destruction of chemical treatment film was recognized, and remarkable seizure occurred.

INDUSTRIAL APPLICABILITY

According to the production method of an internally ribbed steel tube in accordance with the present invention, the drawing plug is preheated before cold drawing for forming spiral ribs, and the heating temperature therefor is controlled, whereby troubles at the time of cold drawing for forming the spiral ribs are suppressed, and the spiral ribs can be formed stably.

Thereby, the internally ribbed steel tube thus obtained is well applicable to increased capacity and higher temperature/higher pressure service for a boiler and therefore can be used widely because it has excellent formability and dimensional accuracy as a boiler steel tube.

What is claimed is:

1. A production method of an internally ribbed steel tube in which a plurality of stripes of spiral ribs are formed along a tube axis direction, the method comprising the steps of:

preparing a blank tube, subjecting said blank tube to a chemical treatment;

preheating a plug to a temperature of 50 to 200° C., the plug having a plurality of stripes of spiral grooves that are provided on the outer surface thereof;

inserting said preheated plug into the inside of said blank tube; and performing cold drawing of said blank tube.

2. The production method of an internally ribbed steel tube according to claim 1, wherein the chemical treatment comprises the steps of:

pickling for removing oxide scale and rust on the tube surface;

forming a zinc phosphate coat on the neutralized tube surface; and forming a lubricant layer on the zinc phosphate coat.

* * * * *